US009080428B1

(12) United States Patent
Rembach et al.

(10) Patent No.: US 9,080,428 B1
(45) Date of Patent: Jul. 14, 2015

(54) DRILLING RIG WITH POSITION AND VELOCITY MEASURING TOOL FOR STANDARD AND DIRECTIONAL DRILLING

(71) Applicants: Paul F. Rembach, Houston, TX (US); Reiner Fiege, Humble, TX (US)

(72) Inventors: Paul F. Rembach, Houston, TX (US); Reiner Fiege, Humble, TX (US)

( * ) Notice: Subject to any disclaimer, the term of this patent is extended or adjusted under 35 U.S.C. 154(b) by 0 days.

(21) Appl. No.: 14/455,628

(22) Filed: Aug. 8, 2014

Related U.S. Application Data

(63) Continuation-in-part of application No. 14/106,616, filed on Dec. 13, 2013, now Pat. No. 8,843,220.

(51) Int. Cl.

| | |
|---|---|
| ***G01M 1/38*** | (2006.01) |
| ***G05B 21/00*** | (2006.01) |
| ***G05B 13/00*** | (2006.01) |
| ***G05B 15/00*** | (2006.01) |
| ***G05B 23/00*** | (2006.01) |
| ***E21B 7/04*** | (2006.01) |
| ***E02D 29/00*** | (2006.01) |
| ***E21B 15/04*** | (2006.01) |
| ***E21B 7/10*** | (2006.01) |
| ***E21B 7/08*** | (2006.01) |
| ***E03B 3/11*** | (2006.01) |
| ***E21B 23/12*** | (2006.01) |
| ***E21B 44/06*** | (2006.01) |
| ***E21B 45/00*** | (2006.01) |

(52) U.S. Cl.
CPC . *E21B 44/06* (2013.01); *E21B 7/04* (2013.01); *E21B 45/00* (2013.01)

(58) Field of Classification Search
CPC ..... E21B 44/06
USPC ..... 700/276; 175/61, 62, 73–75, 82; 166/50, 117.5
See application file for complete search history.

(56) References Cited

U.S. PATENT DOCUMENTS

| | | | | |
|---|---|---|---|---|
| 4,793,421 | A | 12/1988 | Jasinski | |
| 6,918,453 | B2 | 7/2005 | Haci et al. | |
| 7,100,708 | B2 | 9/2006 | Koederitz | |
| 7,461,705 | B2 | 12/2008 | Hulick et al. | |
| 8,360,171 | B2 | 1/2013 | Boone et al. | |
| 8,590,635 | B2 | 11/2013 | Koederitz | |
| 2002/0104685 | A1 | 8/2002 | Pinckard et al. | |
| 2002/0185313 | A1* | 12/2002 | Jones et al. | 175/48 |
| 2008/0156531 | A1 | 7/2008 | Boone et al. | |
| 2009/0057018 | A1* | 3/2009 | Farley | 175/73 |
| 2009/0078462 | A1 | 3/2009 | Boone et al. | |
| 2011/0214919 | A1* | 9/2011 | McClung, III | 175/57 |
| 2013/0043884 | A1* | 2/2013 | Le et al. | 324/601 |
| 2013/0126241 | A1* | 5/2013 | Boone et al. | 175/45 |
| 2014/0202767 | A1* | 7/2014 | Feasey | 175/57 |

* cited by examiner

*Primary Examiner* — Mohammad Ali
*Assistant Examiner* — Ziaul Karim
(74) *Attorney, Agent, or Firm* — Buskop Law Group, PC; Wendy Buskop

(57) ABSTRACT

A drilling rig with a position and velocity measuring tool that provides a self-adjusting auto driller usable for standard drilling and directional drilling in a wellbore. The position and velocity measuring tool has a processor and data storage with computer instructions for instructing the processor to present an operator directional drilling steering system dashboard with numerous graphic visual components which creates and uses a virtual encoder eliminating a failure point of a mechanical encoder.

14 Claims, 8 Drawing Sheets

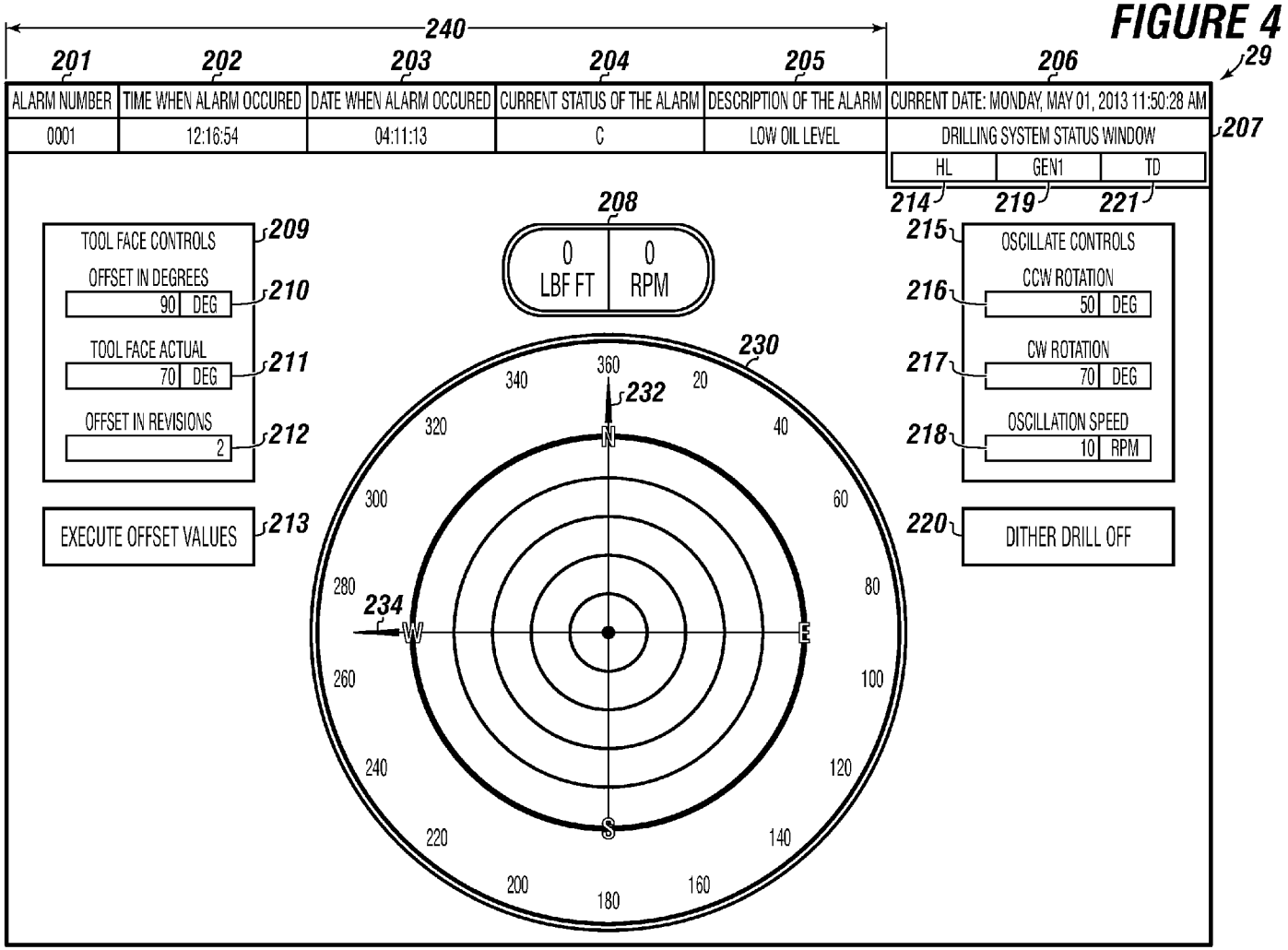
FIGURE 4
29
240
201
202
203
204
205
206
207
ALARM NUMBER
TIME WHEN ALARM OCCURED
DATE WHEN ALARM OCCURED
CURRENT STATUS OF THE ALARM
DESCRIPTION OF THE ALARM
CURRENT DATE: MONDAY, MAY 01, 2013 11:50:28 AM
0001
12:16:54
04:11:13
C
LOW OIL LEVEL
DRILLING SYSTEM STATUS WINDOW
HL
GEN1
TD
214
219
221
208
0 LBF FT
0 RPM
230
232
234
N
E
S
W
360
20
40
60
80
100
120
140
160
180
200
220
240
260
280
300
320
340
209
TOOL FACE CONTROLS
OFFSET IN DEGREES
90 DEG
210
TOOL FACE ACTUAL
70 DEG
211
OFFSET IN REVISIONS
2
212
213
EXECUTE OFFSET VALUES
215
OSCILLATE CONTROLS
CCW ROTATION
50 DEG
216
CW ROTATION
70 DEG
217
OSCILLATION SPEED
10 RPM
218
220
DITHER DRILL OFF

DRILLING RIG WITH POSITION AND VELOCITY MEASURING TOOL FOR STANDARD AND DIRECTIONAL DRILLING

CROSS REFERENCE TO RELATED APPLICATIONS

The present application is a Continuation in Part of co-pending U.S. patent application Ser. No. 14/106,616 filed on Dec. 13, 2013, entitled "POSITION AND VELOCITY MEASUREMENT TOOL FOR STANDARD AND DIRECTIONAL DRILLING." This reference is hereby incorporated in its entirety.

FIELD

The present embodiments generally relate to a drilling rig with a position and velocity measuring tool that provides a self-adjusting auto driller usable for standard drilling and directional drilling in a wellbore.

BACKGROUND

A need exists for a drilling rig with a sensorless, physical encoderless ability to drill in a wellbore for improved reliability.

A need exists for a drilling rig with an auto driller.

The present embodiments meet these needs.

BRIEF DESCRIPTION OF THE DRAWINGS

The detailed description will be better understood in conjunction with the accompanying drawings as follows:

FIG. 4 depicts the operator directional drilling steering system dashboard for use with a top drive.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a drilling rig with a position and velocity measuring tool usable for standard drilling and directional drilling in a wellbore with an auto driller and for directionally operating a top drive.

The embodiments further relate to a drilling rig with increased reliability of top drives having improved continuous operation.

A benefit of the drilling rig with the position and velocity measuring tool is that top drive runaway for the drilling rig is virtually eliminated during drilling when top drive runaway is caused by loss of encoder feedback on the top drive. Top drive runaway causes drill pipes to break and fall, which can cause injuries to workers at a drill site.

Another benefit of the drilling rig with the position and velocity measuring tool is that the position and velocity measuring tool eliminates the need for hardware encoder feedback, which eliminates the need for torque pulsing of the drill pipe from a partially failed encoder, which could shake drill pipe uncontrollably resulting in the shaking of the rig floor causing workers to fall and injure themselves in the event that a make-up or break-out pipe tong is connected.

A further benefit of the drilling rig with the position and velocity measuring tool is that the drilling rig enables drilling for fossil fuels more reliability using software that does not breakdown in place of hardware that breaks down, enabling more wells to be drilled at lower costs by the same drilling rig with reduced maintenance.

Yet another benefit of the drilling rig with the position and velocity measuring tool is that the position and velocity measuring tool provides a more reliable method of drilling with the drilling rig with fewer breakdowns at the drill site by equipment on the drilling rig. Breakdowns often lead to fires and explosions, resulting in serious bodily injury and even death of personnel.

A further benefit of the invention is that the improved drilling rig reduces failure points in the drill string through the elimination of torque pulses caused by the failure of encoder feedback. The elimination of torque pulses caused by the failure of encoder feedback significantly increases the reliability of the top drive on the drilling rig, producing a combination of equipment that results in potential savings of millions of dollars that would be lost in downtime, as well as potential loss of life.

Figure 1:
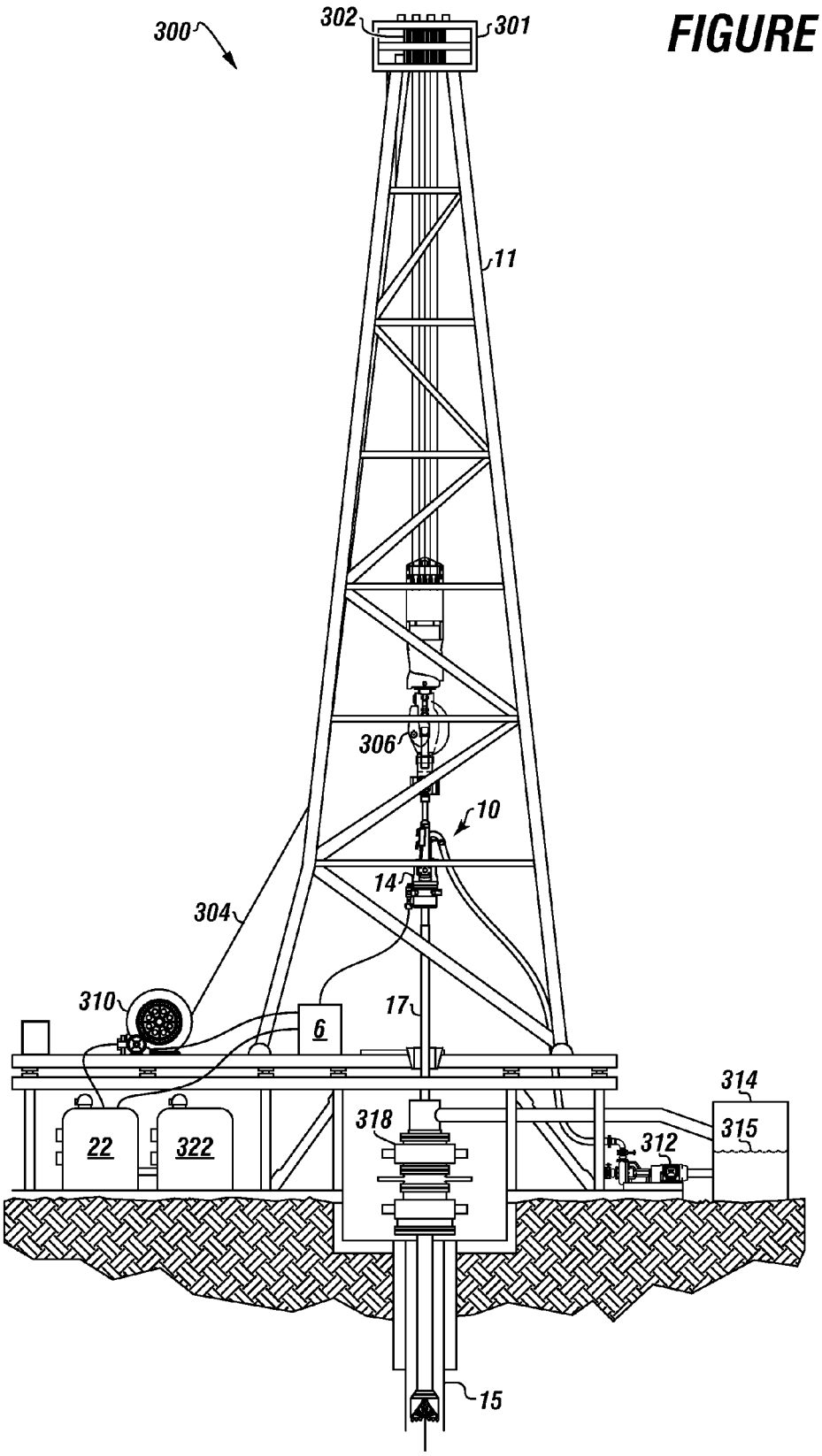
FIG. 1 depicts a drilling rig with a position and velocity measuring tool.

Turning now to the Figures, FIG. 1 depicts a drilling rig 300 with a position and velocity measuring tool 6.

The drilling rig 300 can include a derrick 11 that can support a top drive 14 for installing drill pipe 17 in a wellbore 15. The drilling rig can be an oil and natural gas drilling rig, or a similar rig known in the industry. In embodiments, the derrick can be replaced with a tower. The top drive can be a moveable top drive. The derrick 11 can have a crown 301 with sheaves 302 and a cable 304.

The drilling rig 300 can include a lifting means 306 connected to the cable 304 on one end. The lifting means 306 can be a lifting block, a hook, a pair of bail connectors, each bail connector supporting the top drive on either side, or the like.

The drilling rig 300 can include a drawworks 310 connected to the cable on an end opposite the lifting means for raising and lowering the lifting means 306.

The drilling rig 300 can include a mud pump 312 connected to a mud tank 314 for providing drilling fluid 315 into the wellbore 15. Drilling fluid pressure 10 can come from the mud pump, typically through the top drive into the wellbore.

The drilling rig 300 can include a blowout preventer 318 mounted over the wellbore 15. The drilling rig can include a power supply 22 for providing power to the mud pump, drawworks, top drive and a controller 322. The controller 322 can be in communication with the power supply and equipment on the drilling rig for operating the power supply, drawworks, top drive and mud pump. In embodiments, the power supply can be a generator.

The drilling rig can include the top drive 14 mounted to the lifting means 306. The position and velocity measuring tool 6 can be in communication with the top drive 14 and the drawworks 310.

Figure 2:
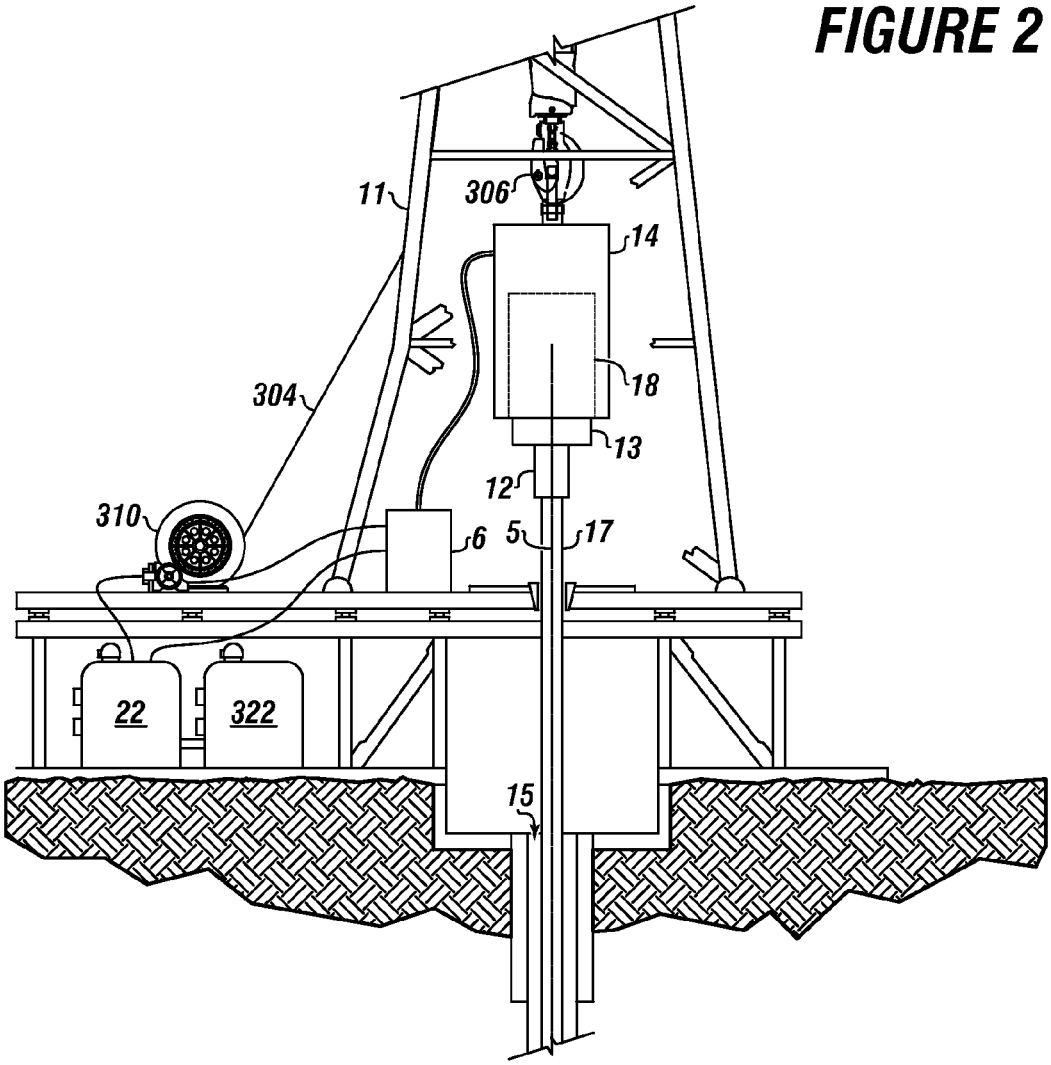
FIG. 2 depicts the position and velocity measuring tool connected to the top drive.

FIG. 2 depicts the position and velocity measuring tool 6 connected to the top drive 14.

The top drive 14 can include an electric motor 18. The position and velocity measuring tool 6 can be connected to the electric motor 18. The electric motor can be connected to a gear 13. The gear 13 can rotate a quill 12 that engages the drill pipe 17 as the drill pipe is run into the wellbore 15. The quill 12 can have a central axis 5 which parallels the wellbore.

The derrick 11, lifting means 306, cable 304, drawworks 310, power supply 22 and controller 322 are also shown.

Figure 3:
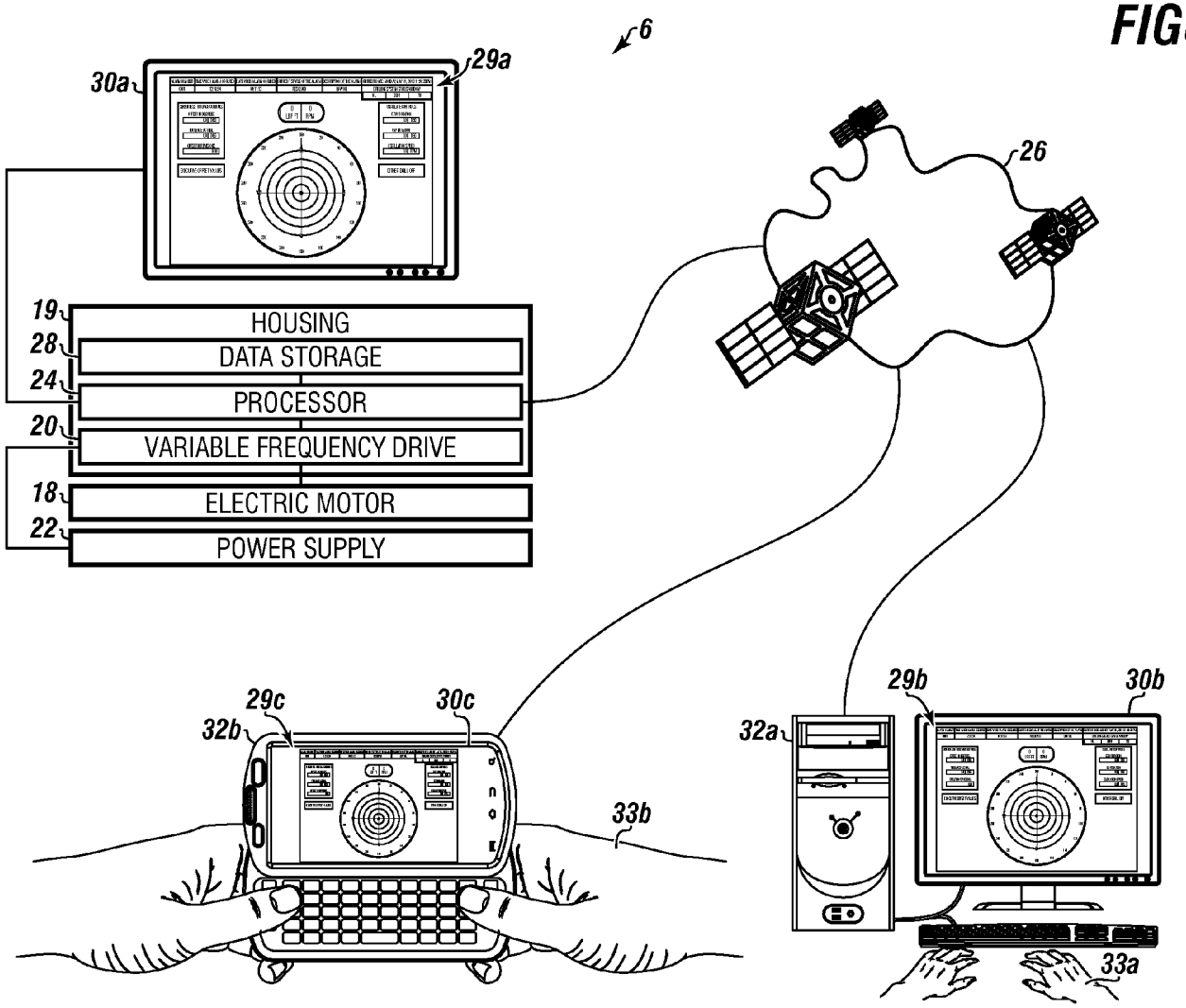
FIG. 3 depicts the position and velocity measuring tool connected to a network.

FIG. 3 depicts the position and velocity measuring tool 6 connected to a network 26.

The position and velocity measuring tool 6 can include a housing 19. The housing 19 can contain a data storage 28, a processor 24 and a variable frequency drive 20. The processor 24 can be connected to a network 26.

The term "data storage" refers to a non-transitory computer readable medium, such as a hard disk drive, solid state drive, flash drive, tape drive, and the like. The term "non-transitory computer readable medium" excludes any transitory signals but includes any non-transitory data storage circuitry, e.g., buffers, cache, and queues, within transceivers of transitory signals.

The data storage 28 can include computer instructions to produce an operator directional drilling steering system dashboard 29*a* for steering the drill pipe using the top drive viewable on a display 30*a*, which can be connected to the housing 19 of the position and velocity measuring tool 6. Additional operator directional drilling steering system dashboards 29*b* and 29*c* can also be displayed on additional displays 30*b* and 30*c* of client devices 32*a* and 32*b*.

In embodiments, the data storage 28 can be remote to the housing 19 for communication through the network 26.

The processor 24 can be a computer or a programmable logic controller. The processor 24 can be a plurality of processors connected together, such as a cloud based processing system.

The processor 24 can communicate with the display 30*a*, which can be remote to the top drive. The display 30*a* can be connected directly or wirelessly to the processor 24 through the network 26. The processor 24 can communicate with the client devices 32*a* and 32*b* through the network 26. Remote users 33*a* and 33*b* can operate the client devices.

The variable frequency drive 20 can communicate with and have an electrical connection to the processor 24 which can communicate to the data storage 28. The variable frequency drive 20 can connect to the power supply 22 that can supply power to the processor and various drilling equipment. In embodiments, a generator on the drilling rig can supply power to the processor. The variable frequency drive 20 can connect to the electric motor 18 in the top drive.

The network 26 can be a satellite network, the internet, a cellular network, a local area network, another global communication network, a wide area network, combinations thereof or several of these networks connected together.

The client devices 32*a* and 32*b* can be cellular phones, laptops, tablets other computers, tablets, personal digital assistants, or a similar device known in the industry with a processor, data storage and ability to connect to a network.

In embodiments, a client device can simply display the alarm portion of the operator directional drilling steering system dashboard enabling executives that are remote to a drilling site to closely monitor the drilling and take steps to prevent a blow out or possible explosion when the quill deviates too much from the desired orientation.

FIG. 4 depicts the operator directional drilling steering system dashboard.

The operator directional drilling steering system dashboard 29 can depict alarm information 240. Alarm information 204 can include an alarm number 201, such as 0001; time when alarm occurred 202, such as 12:16:54 on a 24 hour clock; date when alarm occurred 203, such as 04:11:13; current status of the alarm 204, such as "C" when the alarm comes in with the message or "CD" when the same alarm is resolved; and description of the alarm 205, such as "low oil level" for pump 001. The description can also refer to low oil pressure or other descriptions.

The letter "C" represents that the alarm is coming, which is an industry standard in alarm logic from Europe, particularly in Germany as "kommt" and "geht." Alarms come and go, so the letters relate to coming and going. The letter "D" represents that the alarm has disappeared. If the letter "D" is used, then the alarm is generally resolved.

The operator directional drilling steering system dashboard 29 can depict a current date 206 for the moment in time that the operator is viewing the operator directional drilling steering system dashboard. In embodiments, the current date can be shown as a day of the week, a month, a year, and an hour with minutes and seconds.

The operator directional drilling steering system dashboard 29 can depict a drilling system status window 207 with at least three indicators showing power generation and status of the drilling equipment. High line (HL) 214 represents high line which is power from a power grid. Generator one (Gen1) 219 represents generator 1. Top drive (TD) 221 represents the top drive. Each indicator can be illuminated when power is provided or the device is running.

The operator directional drilling steering system dashboard 29 can depict a drill string meter 208. The drill string meter can show revolutions per minute of the quill, such as 0 rpm, and torque in foot-pounds on the quill, such as 0 lbf ft.

The position and velocity measuring tool can measure revolutions per minute and torque of the top drive, which can be up to 400 rpm and up to 50,000 foot-pounds respectively, which can be provided as a feedback communication from the variable frequency drive to the processor and into the non-transitory computer medium. Typical settings for a small top drive can be lower than settings for a larger top drive.

The operator directional drilling steering system dashboard 29 can depict tool face controls 209 which can display and enable modification of orientations of the quill connected to the drill string. The position and velocity measuring tool can provide a virtual encoder replacing the need for an actual encoder for the top drive.

The tool face controls 209 can include offset in degrees 210, which can be a set value on how much an operator wants to turn a quill.

The tool face controls 209 can include a tool face actual degree orientation 211. Due to the elasticity of the drill string, a rotation in degrees, such as 90 degrees at the quill, does not equal the rotation of the tool face in the wellbore. For example, the tool face can only rotate 10 degrees in the wellbore with a 90 degree rotation of the quill at the top drive. The tool face actual orientation can be entered into the tool face actual degree orientation 211 to correct for downhole resistance and the elasticity of the drill pipe.

The tool face controls 209 can include an offset in revision 212. The offset in revision can indicate an offset in degrees plus at least one complete 360 degree rotation of the drill string. The offset in revision indicates 720 degrees of rotation, which is 360 multiplied by 2. The offset in revisions 212 represents a quantity of 360 degree rotations around the axis of the quill.

The operator directional drilling steering system dashboard 29 can have an execute offset values activation button 213 to activate computer instructions to instruct the processor to operate the electric motor to rotate the quill to the degrees input to the tool face controls. The execute offset values activation button 213 can execute the offset in degrees, the tool face actual degree orientation and the offset in revisions of the tool face controls.

The operator directional drilling steering system dashboard 29 can depict oscillate controls 215 which can display and enable changing of an amount of rotation of the quill to rock the drill string while drilling within the formation. The oscillate controls can include counterclockwise rotation in degrees 216, clockwise rotation in degrees 217, and oscillation speed 218.

Counterclockwise rotation in degrees 216 can be an amount of degrees in a counterclockwise rotation the quill imparts to the drill string. The drill string can rotate counterclockwise to enable a dithering action of the drill string between clockwise and counterclockwise rotation. The counterclockwise rotation in degrees is shown as 50 degrees, which indicates a counterclockwise rotation of the quill from a stationary point to a degree orientation 50 degrees from that point. The stationary point can be the tool face actual degree orientation 211.

Clockwise rotation in degrees 217 can be an amount of degrees in a clockwise rotation which the quill imparts to the drill string. The clockwise rotation in degrees is shown as 70 degrees, which indicates a clockwise rotation from the stationary point to a degree orientation 70 degrees from that point. The stationary point can be the tool face actual degree orientation 211.

Oscillation speed 218 can be a value of revolutions per minute the quill is to impart to the drill string to achieve the rocking while drilling within the formation desired by the operator. The oscillation speed is shown as 10 rpm indicating a rotation of the quill.

The operator directional drilling steering system dashboard 29 can have a dither drill on/off button 220, which can be connected to computer instructions to instruct the processor to start or stop the electric motor to rotate the quill to the degrees input to the oscillate controls. The text of the dither drill on/off button 220 can change to indicate the operating drill status. In an embodiment, the dither drill on/off button can be configured to display two buttons, one for off and one for on.

The operator directional drilling steering system dashboard 29 can have a quill pointer 232, which can point to a degree number that indicates the current rotation of the quill.

The operator directional drilling steering system dashboard 29 can have a tool face pointer 234, which can point to a degree number that indicates the current position of the tool face. The tool face pointer 234 can be formed on a wellbore map 230 indicating rotation of the tool face.

Information from the tool face can occur every few seconds. Dots can be placed on the target to show where the tool face is located. The update time can be variable depending upon the depth of the tool face within the well.

Computer instructions can colorize the operational condition to be green for normal operation, yellow for warning that a non-fatal fault is occurring in the operating system and red for a critical warning that the top drive has shut down to preserve the tool.

Figure 5A:
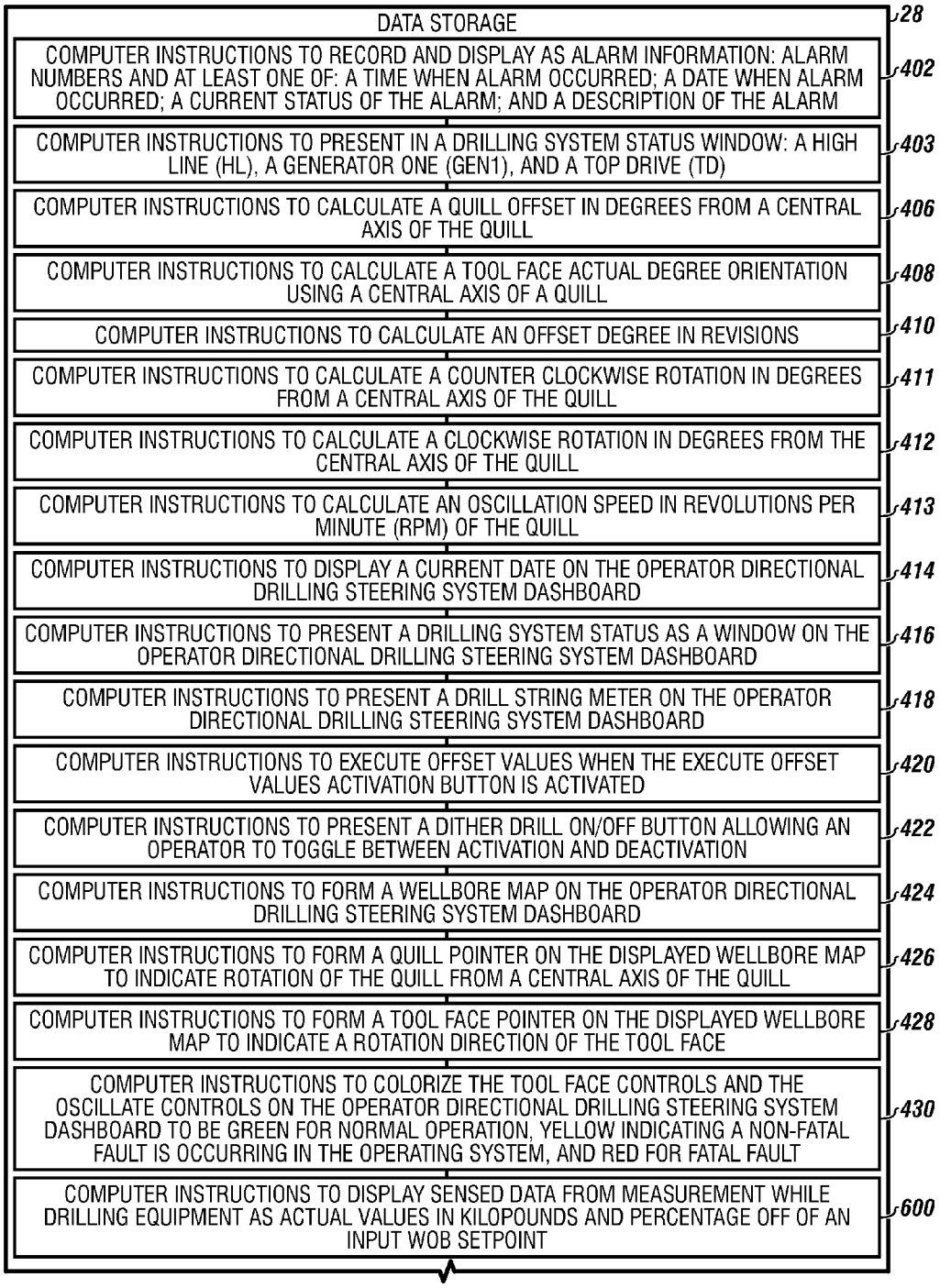
FIGS. 5A-5C depict a diagram of the data storage according to one or more embodiments.
Figure 5B:
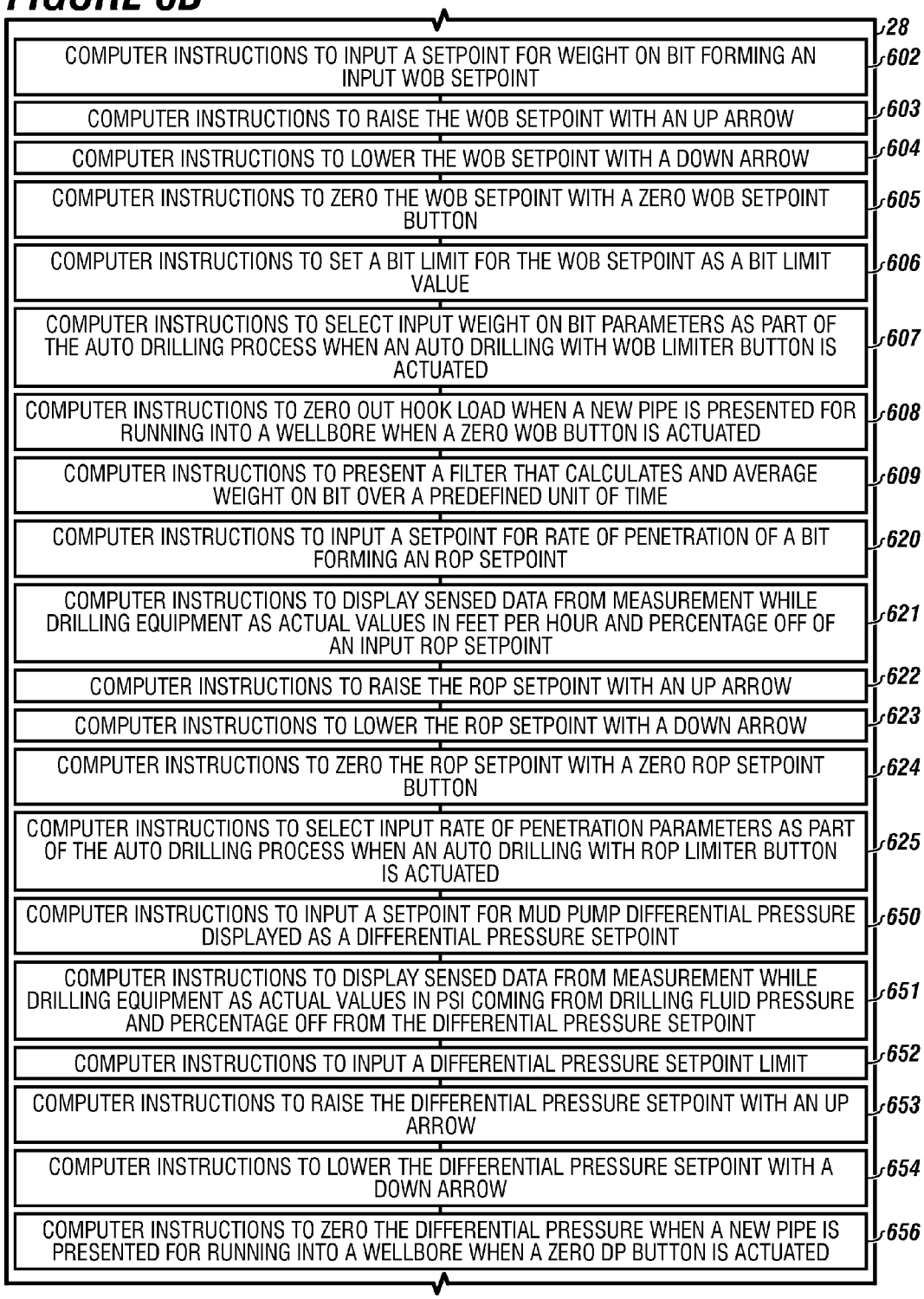
Figure 5C:
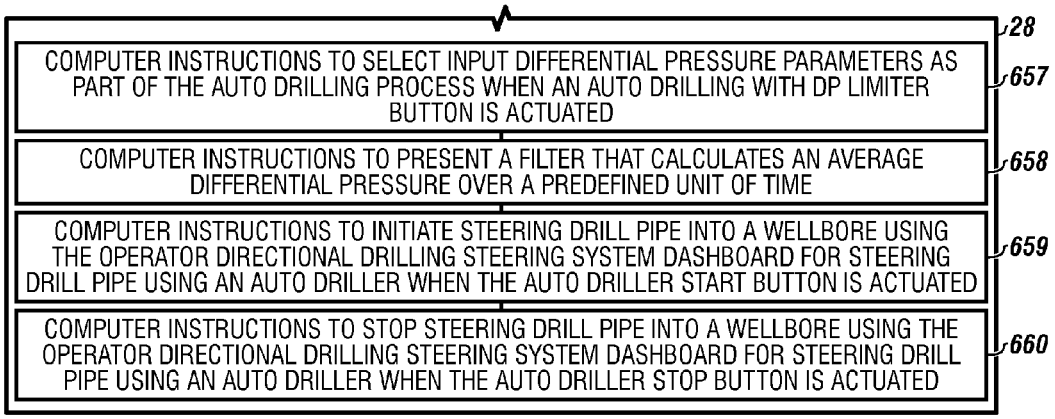

FIGS. 5A-5C depict a diagram of the data storage according to one or more embodiments.

The data storage 28 can include computer instructions 402 to record and display as alarm information: alarm numbers and at least one of: a time when alarm occurred; a date when alarm occurred; a current status of the alarm; and a description of the alarm.

The data storage 28 can include computer instructions 403 to present in a drilling system status window: a high line (HL), a generator one (GEN1), and a top drive (TD). For operation, two of the windows should always be on or colored green. The two windows that should always be on will either be the combination of the top drive and high line, or top drive and generator one.

The data storage 28 can include computer instructions 406 to calculate a quill offset in degrees from a central axis of the quill.

The data storage 28 can include computer instructions 408 to calculate a tool face actual degree orientation using a central axis of a quill.

The data storage 28 can include computer instructions 410 to calculate an offset degree in revisions.

The data storage 28 can include computer instructions 411 to calculate a counter clockwise rotation in degrees from a central axis of the quill.

The data storage 28 can include computer instructions 412 to calculate a clockwise rotation in degrees from the central axis of the quill.

The data storage 28 can include computer instructions 413 to calculate an oscillation speed in revolutions per minute of the quill.

The data storage 28 can include computer instructions 414 to display a current date on the operator directional drilling steering system dashboard.

The data storage 28 can include computer instructions 416 to present a drilling system status as a window on the operator directional drilling steering system dashboard.

The data storage 28 can include computer instructions 418 to present a drill string meter on the operator directional drilling steering system dashboard.

The data storage 28 can include computer instructions 420 to execute offset values when the execute offset values activation button is activated.

The data storage 28 can include computer instructions 422 to present a dither drill on/off button allowing an operator to toggle between activation and deactivation.

The data storage 28 can include computer instructions 424 to form a wellbore map on the operator directional drilling steering system dashboard.

The data storage 28 can include computer instructions 426 to form a quill pointer on the displayed wellbore map to indicate rotation of the quill from a central axis of the quill.

The data storage 28 can include computer instructions 428 to form a tool face pointer on the displayed wellbore map to indicate a rotation direction of the tool face.

The data storage 28 can include computer instructions 430 to colorize the tool face controls and the oscillate controls on the operator directional drilling steering system dashboard to be green for normal operation, yellow indicating a non-fatal fault is occurring in the operating system, and red for fatal fault. For example, red can be a critical warning that the top drive has shut down to preserve the tool.

Figure 6:
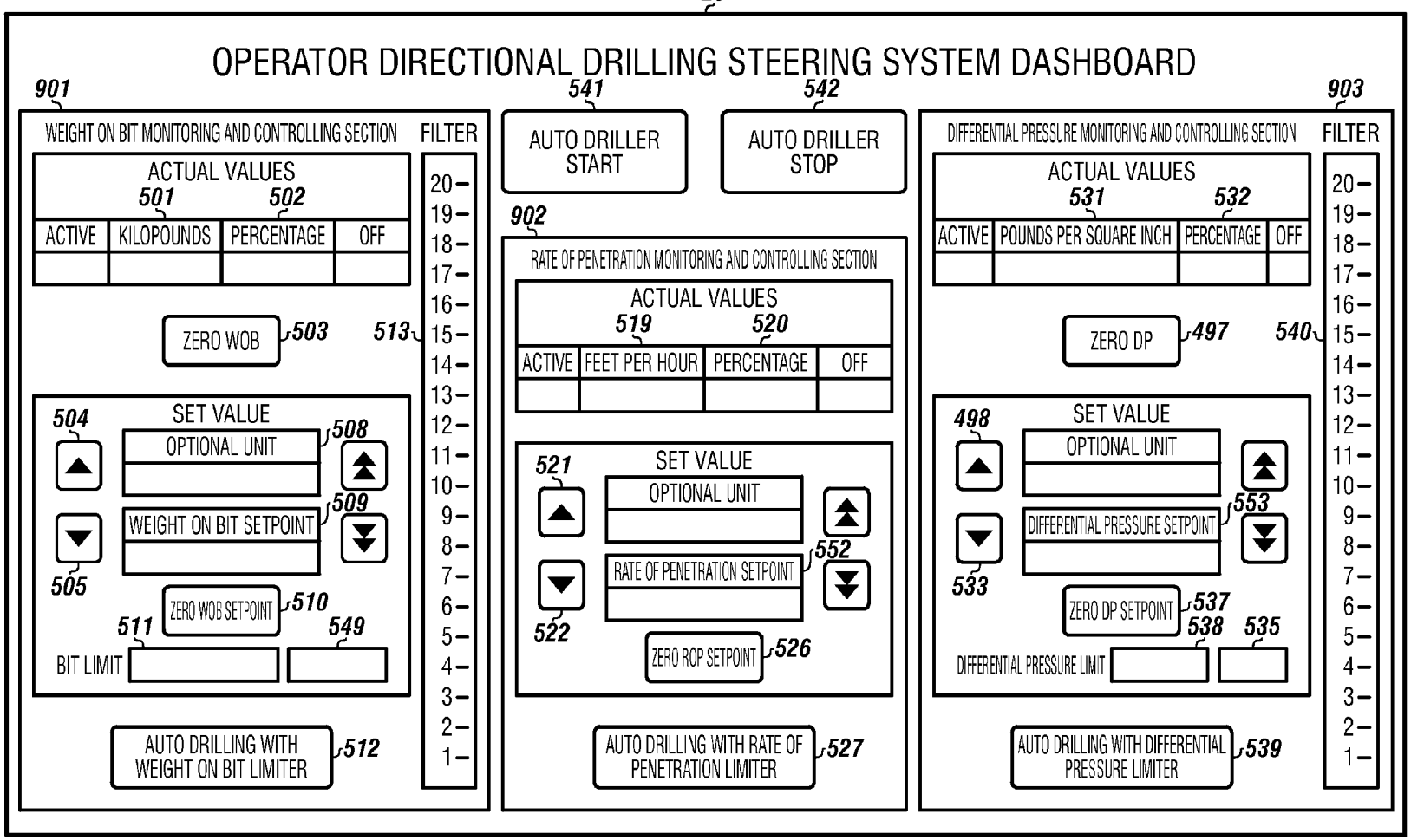
FIG. 6 depicts an embodiment of the operator directional drilling steering system dashboard.

The data storage 28 can include the following computer instructions to create an embodiment of the operator directional drilling steering system dashboard, which is shown in FIG. 6, for steering drill pipe using an auto-driller presenting at least one of: a weight on bit monitoring and controlling section, a rate of penetration monitoring and controlling section, and a differential pressure monitoring and controlling section.

Computer instructions 600-609 can be usable with the weight on bit monitoring and controlling section.

The data storage 28 can include computer instructions 600 to display sensed data from measurement while drilling equipment as actual values in kilopounds and percentage off of an input WOB setpoint.

The data storage 28 can include computer instructions 602 to input a setpoint for weight on bit forming an input WOB setpoint.

The data storage 28 can include computer instructions 603 to raise the WOB setpoint with an up arrow.

The data storage 28 can include computer instructions 604 to lower the WOB setpoint with a down arrow.

The data storage 28 can include computer instructions 605 to zero the WOB setpoint with a zero WOB setpoint button.

The data storage 28 can include computer instructions 606 to set a bit limit for the WOB setpoint as a bit limit value.

The data storage 28 can include computer instructions 607 to select input weight on bit parameters as part of the auto drilling process when an auto drilling with WOB limiter button is actuated.

The data storage 28 can include computer instructions 608 to zero out hook load when a new pipe is presented for running into a wellbore when a zero WOB button is actuated.

The data storage 28 can include computer instructions 609 to present a filter that calculates and average weight on bit over a predefined unit of time.

Computer instructions 620-625 can be usable with the rate of penetration monitoring and controlling section.

The data storage 28 can include computer instructions 620 to input a setpoint for rate of penetration of a bit forming an ROP setpoint.

The data storage 28 can include computer instructions 621 to display sensed data from measurement while drilling equipment as actual values in feet per hour and percentage off of an input ROP setpoint.

The data storage 28 can include computer instructions 622 to raise the ROP setpoint with an up arrow.

The data storage 28 can include computer instructions 623 to lower the ROP setpoint with a down arrow.

The data storage 28 can include computer instructions 624 to zero the ROP setpoint with a zero ROP setpoint button.

The data storage 28 can include computer instructions 625 to select input rate of penetration parameters as part of the auto drilling process when an auto drilling with ROP limiter button is actuated.

Computer instructions 650-658 can be usable with the differential pressure monitoring and controlling section.

The data storage 28 can include computer instructions 650 to input a setpoint for mud pump differential pressure displayed as a differential pressure setpoint.

The data storage 28 can include computer instructions 651 to display sensed data from measurement while drilling equipment as actual values in psi coming from drilling fluid pressure and percentage off from the differential pressure setpoint.

The data storage 28 can include computer instructions 652 to input a differential pressure setpoint limit.

The data storage 28 can include computer instructions 653 to raise the differential pressure setpoint with an up arrow.

The data storage 28 can include computer instructions 654 to lower the differential pressure setpoint with a down arrow.

The data storage 28 can include computer instructions 656 to zero the differential pressure when a new pipe is presented for running into a wellbore when a zero DP button is actuated.

The data storage 28 can include computer instructions 657 to select input differential pressure parameters as part of the auto drilling process when an auto drilling with DP limiter button is actuated.

The data storage 28 can include computer instructions 658 to present a filter that calculates an average differential pressure over a predefined unit of time.

The data storage 28 can include computer instructions 659 to initiate steering drill pipe into a wellbore using the operator directional drilling steering system dashboard for steering drill pipe using an auto driller when the auto driller start button is actuated.

The data storage 28 can include computer instructions 660 to stop steering drill pipe into a wellbore using the operator directional drilling steering system dashboard for steering drill pipe using an auto driller when the auto driller stop button is actuated. These computer instructions can produce linear continuously adjusted setpoints during drilling without the need for using look up tables, indexes or lists, by using actual drilling data with setpoints and linearly adjusted setpoints, while drilling a wellbore.

FIG. 6 depicts an embodiment of an operator directional drilling steering system dashboard.

This embodiment of the operator directional drilling steering system dashboard 29 can be used for steering drill pipe using an auto driller presenting at least one of: a weight on bit monitoring and controlling section 901, a rate of penetration monitoring and controlling section 902, and a differential pressure monitoring and controlling section 903. The monitoring and controlling sections can be simultaneously viewable on the display and can use at least one of the values presented to optimize best penetration rate for a wellbore The weight on bit monitoring and controlling section 901 can display actual values of sensed data from measurement while drilling equipment in kilopounds 501 and percentage 502 off of an input WOB setpoint.

The weight on bit monitoring and controlling section 901 can display a weight on bit setpoint 509 and an optional unit 508 which can be in pounds.

The weight on bit monitoring and controlling section 901 can display a bit limit value 511 with optional bit units 549.

The weight on bit monitoring and controlling section 901 can display an auto drilling with WOB limiter button 512.

The weight on bit monitoring and controlling section 901 can display a zero WOB button 503 which when actuated will zero the hook load when a new pipe is presented for running into a wellbore.

The weight on bit monitoring and controlling section 901 can display a filter 513 that calculates and averages weight on bit over a predefined unit of time, such as 2 seconds.

The weight on bit monitoring and controlling section 901 can display an up arrow 504 to raise the WOB setpoint and a down arrow 505 to lower the WOB setpoint.

The weight on bit monitoring and controlling section 901 can display a zero WOB setpoint button 510 that can zero the setpoint for weight on bit when actuated.

The rate of penetration monitoring and controlling section 902 can display an ROP setpoint 552.

The rate of penetration monitoring and controlling section 902 can display sensed actual values from measurement while drilling equipment in feet per hour 519 and as a percentage off of an input ROP setpoint 520.

The rate of penetration monitoring and controlling section 902 can display an input rate of penetration parameter as part of the auto drilling process when an auto drilling with ROP limiter button 527 is actuated.

The rate of penetration monitoring and controlling section 902 can display an up arrow 521 to raise the ROP setpoint and a down arrow 522 to lower the ROP setpoint.

The rate of penetration monitoring and controlling section 902 can display a zero ROP setpoint button 526 to zero the ROP setpoint.

The differential pressure monitoring and controlling section 903 can display actual values of data sensed from measurement while drilling equipment in pounds per square in 531 which is the psi coming from drilling fluid pressure, and percentage off from the differential pressure setpoint 532.

The differential pressure monitoring and controlling section 903 can display a differential pressure setpoint 553 enabling a user or other computer input a setpoint for mud pump differential pressure.

The differential pressure monitoring and controlling section 903 can display a differential pressure setpoint limit 538 with optional units in psi 535.

The differential pressure monitoring and controlling section 903 can display an auto drilling with DP limiter button 539 that activates computer instructions that select input differential pressure parameters as part of the auto drilling process.

The differential pressure monitoring and controlling section 903 can display a filter 540 that calculates an average differential pressure over a predefined unit of time, such as 2 seconds.

The differential pressure monitoring and controlling section 903 can display an up arrow 498 to raise the differential pressure setpoint and a down arrow 533 to lower the differential pressure setpoint.

The differential pressure monitoring and controlling section 903 can display a zero DP button 497 to zero out differential pressure when a new pipe is presented for running into a wellbore.

The differential pressure monitoring and controlling section 903 can display a zero DP setpoint button 537 to zero the differential pressure setpoint.

The operator directional drilling steering system dashboard 29 can include an auto driller start button 541 to initiate steering drill pipe into a wellbore.

The operator directional drilling steering system dashboard 500 can include an auto driller stop button 542 to stop steering drill pipe into a wellbore.

The operator directional drilling steering system dashboard 29 can produce linear continuously adjusted setpoints during drilling without the need for using look up tables, indexes or lists, by using actual drilling data with setpoints and linearly adjusted setpoints, while drilling a wellbore.

In embodiments, the position and velocity measuring tool can be a drill bit, directional drilling tools, tools associated with downhole assemblies, fishing tools, a casing hanger, a swell packer, a packer assembly, or combinations thereof.

To use the embodiments to steer a quill, the operator can log into the system with a user name and password.

Next, the operator can select the operator directional drilling steering system dashboard to be displayed.

The display can be connected to a processor and the data storage which can communicate to a variable frequency drive for operating an electric motor connected to a gear box mounted on the top drive.

The operator can see alarm information and a current date on the display.

If an alarm is indicated in the alarm information, the operator can investigate the cause of the alarm or notify another worker to investigate.

The alarm information allows the operator to check the time, date, status and description of each alarm in the alarm information section. Multiple alarms with multiple statuses can be viewed simultaneously by the operator and by users of client devices connected to the network and the processor.

The operator can next check the operational status of the top drive by looking at the drilling system status window. The drilling system status window can show that power is available or not available and that the top drive is ready to run or stopped.

Next, the operator can check the tool face controls. The operator can reset the position of the tool face in the wellbore by inputting different numbers into the tool face controls changing the offset in degrees and the offset in revisions, which results in a change to the tool face actual degree orientation.

For example, if the operator wants to reset a tool face actual degree orientation by 3 degrees, the operator can recognize that the drill string has torque applied against it. The operator can then reduce torque by applying 2 offset revisions, spinning the drill pipe two revolutions, 720 degrees, to reduce the torque.

Simultaneously with that spinning, the operator can additionally use an input of 10 degrees for offset in degrees to result in a 3 degree turn in the tool face actual degree orientation for a total of 730 degrees.

The reason for doing this is to account for the elasticity of the drill pipe.

When the operator presses the execute offset values activation button, both variables are input to the processor simultaneously, and the quill is moved by the gear and electric motor causing the tool face actual degree orientation to change by 3 degrees.

Once the execute offset values activation button is pressed, the quill pointer can be examined to indicate the quill moved 730 degrees, two complete revolutions plus the 10 degrees, and verify that the tool face pointer moved the necessary 3 degrees.

An operator can make these changes using the tool face controls to obtain a better rate of penetration, such as faster rate of penetration through the rock being drilled.

Next, the operator can check the oscillate controls. The operator can reset the counterclockwise rotation in degrees, the clockwise rotation in degrees and oscillation speed.

For example, the operator can understand that the formation into which the drill bit is being drilled is about to encounter a granite boulder. A dithering motion of the drill bit can optimize fragmentation and penetration through the granite boulder. The operator can change the counterclockwise rotation in degrees to 50 degrees and the clockwise rotation in degrees to 70 degrees and increase the oscillation speed by 10 rpm to cause the drill to penetrate the granite boulder faster and without breaking the drill bit.

An operator can make changes to the oscillate controls to optimize drilling penetration through challenging rock or through soft shale.

An operator can view the drill string meter if the top drive is running, which reveals revolutions per minute of the quill and torque in foot-pounds on the quill to see if the drill string is safely turning. The drill string meter can be used with or without oscillation.

The embodiments can control both toque and sliding of the tool face in a wellbore.

The operator can activate the dither drill on/off button to either turn on or turn off the dither drill control of the top drive. The dither drill control controls the oscillation of the tool face while drilling.

The operator can view a wellbore map with a quill pointer that indicates rotation of the quill and a tool face pointer that indicates rotation of the tool face.

When the tool face pointer overlaps the quill pointer, the operator knows that the tool face and quill are at the same position. Typically the quill and tool face are not at the same position, because there is deflection in the tubulars of the drill string.

While the system is running and oscillating, the embodiments do not require the shut off of the quill to remove torque from the drill string and does not require shut off of the top drive to re-orient the drill string while the quill is off.

Turning off the quill costs the drilling operator time and money with no return on investment. Drilling stops when the quill is motionless.

The embodiments enable adjustment of the tool face while continuing to oscillate the drill string with the quill.

In embodiments, the data storage is a non-transitory computer medium.

While these embodiments have been described with emphasis on the embodiments, it should be understood that within the scope of the appended claims, the embodiments might be practiced other than as specifically described herein.

What is claimed is:

1. A drilling rig with a position and velocity measuring tool for drilling a wellbore, wherein the drilling rig comprises:

a. a derrick with a crown with sheaves and a cable;

b. a lifting means connected to the cable on one end;

c. a drawworks connected to the cable on an end opposite the lifting means for raising and lowering the lifting means;

d. a power supply for providing power to a mud pump, the drawworks, a top drive and the position and velocity measuring tool;

e. a controller for operating the power supply, the drawworks, the top drive and the mud pump;

f. the top drive mounted to the lifting means, wherein the top drive comprises:

(i) a quill with a central axis, wherein the quill is operable by the top drive without use of an encoder and without use of sensors on drill pipe to orient the drill pipe in the wellbore, and wherein the quill is for connecting to rotating drill pipe;

(ii) an electric motor; and (iii) a gear connected to the electric motor and the quill;

g. the position and velocity measuring tool comprising: a processor, a data storage connected to the controller for operating the drawworks, wherein the position and velocity measuring tool automatically controls the drilling by adjusting linearly and continuously, setpoints during drilling without a need for using look up tables, indexes or lists, and by using actual drilling data with setpoints and linearly adjusted setpoints; and h. wherein the data storage comprises: at least one operator directional drilling steering system dashboard using an auto driller presenting at least one of: a weight on bit monitoring and controlling section, a rate of penetration monitoring and controlling section, and a differential pressure monitoring and controlling section, wherein the at least one operator directional drilling steering system dashboard for steering drill pipe by rotating the top drive by degrees and by revolutions per minute simultaneously is viewable on at least one display, and wherein the at least one operator directional drilling steering system dashboard comprises:

(i) alarm information;

(ii) a current date;

(iii) a drilling system status window;

(iv) a drill string meter displaying revolutions per minute of the quill and torque in foot-pounds on the quill; and (v) tool face controls comprising:

1) an offset in degrees from the central axis of the quill;

2) a tool face actual degree orientation from the central axis of the quill; and 3) an offset in revisions, which represents a quantity of 360 degree rotations around the central axis of the quill;

4) an execute offset values activation button, which executes the offset in degrees, the tool face actual degree orientation and the offset in revisions of the tool face controls; and 5) oscillate controls comprising:

a) a counterclockwise rotation in degrees around the central axis of the quill;

b) a clockwise rotation in degrees around the central axis of the quill;

c) an oscillation speed in revolutions per minute around the central axis of the quill;

d) a dither drill on/off button, wherein the dither drill on/off button toggles between an activation status and a deactivation status;

e) a wellbore map;

f) a quill pointer formed on the wellbore map indicating rotation of the quill; and g) a tool face pointer formed on the wellbore map indicating rotation of the tool face;

i. wherein the at least one operator directional drilling steering system dashboard is formed using computer instructions instructing the processor to:

(i) display sensed data from measurement while drilling equipment as actual values in kilopounds and percentage off of an input weight on bit setpoint;

(ii) input a setpoint for weight on bit forming a input weight on bit setpoint;

(iii) set a bit limit for the setpoint for the weight on bit as a bit limit value;

(iv) select input weight on bit parameters as part of the auto drilling process when an auto drilling with weight on bit limiter button is actuated;

(v) zero out hook load when a new pipe is presented for running into a wellbore when a zero weight on bit button is actuated;

(vi) present a filter that calculates an average weight on bit over a predefined unit of time;

(vii) input a setpoint for rate of penetration of a bit forming an rate of penetration setpoint;

(viii) display sensed data from measurement while drilling equipment as actual values in feet per hour and percentage off of an input rate of penetration setpoint;

(ix) select input rate of penetration parameters as part of the auto drilling process when an auto drilling with rate of penetration limiter button is actuated;

(x) input a setpoint for mud pump differential pressure displayed as a differential pressure setpoint;

(xi) display sensed data from measurement while drilling equipment as actual values in psi coming from drilling fluid pressure and percentage off from the differential pressure setpoint;

(xii) input a differential pressure setpoint limit;

(xiii) select input differential pressure parameters as part of the auto drilling process when an auto drilling with differential pressure limiter button is actuated;

(xiv) present a filter that calculates an average differential pressure over a predefined unit of time;

(xv) initiate steering drill pipe into a wellbore using the at least one operator directional drilling steering system dashboard for steering drill pipe using an auto-driller when the auto driller start button is actuated; and (xvi) stop steering drill pipe into a wellbore using the at least one operator directional drilling steering system dashboard for steering drill pipe using an auto-driller when the auto driller stop button is actuated; and wherein the computer instructions produce linear continuously adjusted setpoints during drilling without the need for using look up tables, indexes or lists, by using actual drilling data with setpoints and linearly adjusted setpoints, while drilling a wellbore.

2. The drilling rig of claim 1, wherein the at least one operator directional drilling steering system dashboard uses computer instructions in the data storage to instruct the processor to present information on the operator directional drilling steering system dashboard, wherein the data storage comprises computer instructions instructing the processor to:

a. present alarm information;
b. calculate a quill offset in degrees from the central axis of the quill;
c. calculate the tool face actual degree orientation using the central axis of the quill;
d. calculate an offset degree in revisions;
e. calculate the counterclockwise rotation in degrees from the central axis of the quill;
f. calculate the clockwise rotation in degrees from the central axis of the quill;
g. calculate the oscillation speed in revolutions per minute of the quill;
h. display a current date on the at least one operator directional drilling steering system dashboard connected to the top drive;
i. present a drilling system status as a window on the at least one operator directional drilling steering system dashboard connected to the top drive;
j. present the drill string meter on the at least one operator directional drilling steering system dashboard connected to the top drive;
k. execute offset values when the execute offset values activation button is activated;
l. present the dither drill on/off button allowing an operator to toggle between activation and deactivation;
m. form the wellbore map on the at least one operator directional drilling steering system dashboard connected to the top drive;
n. form the quill pointer on the displayed wellbore map to indicate rotation of the quill from the central axis of the quill; and
o. form the tool face pointer on the displayed wellbore map to indicate a rotation direction of the tool face, wherein the position and velocity measuring tool controls the quill without use of an encoder and without use of sensors.

3. The drilling rig of claim 2, wherein the data storage further comprises computer instructions instructing the processor to record and display as alarm information: alarm numbers and at least one of:

a. a time when alarm occurred;
b. a date when alarm occurred;
c. a current status of the alarm; and
d. a description of the alarm.

4. The drilling rig of claim 2, wherein the data storage further comprises computer instructions instructing the processor to present in the drilling system status window: a high line (HL), a generator one (GEN1), and a top drive (TD).

5. The drilling rig of claim 2, wherein the data storage further comprises computer instructions instructing the processor to colorize the tool face controls and the oscillate controls on the at least one operator directional drilling steering system dashboard to be green for a normal operation, yellow indicating a non-fatal fault is occurring in the operating system, and red for a fatal fault.

6. The drilling rig of claim 2, wherein the dither drill on/off button shows the activation status on the dither drill on/off button.

7. The drilling rig of claim 1, further comprising at least one client device connected to a network and the processor, wherein the at least one client device visually displays the at least one operator directional drilling steering system dashboard to a remote user.

8. The drilling rig of claim 1, wherein the position and velocity measuring tool is usable with at least one of: a drill bit, directional drilling tools, tools associated with downhole assemblies, fishing tools, a casing hanger, a swell packer, a packer assembly, and combinations thereof.

9. The drilling rig of claim 1, comprising a blowout preventer mounted over the wellbore.

10. The drilling rig of claim 1, wherein the mud pump is connected to a mud tank for providing drilling fluid into the wellbore.

11. The drilling rig of claim 1, wherein the weight on bit monitoring and controlling section comprises computer instructions instructing the processor to:

a. raise the setpoint for weight on bit with an up arrow;
b. lower the setpoint for weight on bit with a down arrow;
c. adjust setpoints; and
d. zero the setpoint for weight on bit with zero button.

12. The drilling rig of claim 1, wherein the rate of penetration monitoring and controlling section comprises computer instructions instructing the processor to:

a. raise the setpoint for rate of penetration with an up arrow;
b. lower the setpoint for rate of penetration on bit with a down arrow; and
c. zero the setpoint for rate of penetration on bit with zero button.

13. The drilling rig of claim 1, wherein the differential pressure monitoring and controlling section comprises computer instructions instructing the processor to:

a. raise the setpoint for differential pressure with an up arrow;
b. lower the setpoint for differential pressure with a down arrow; and
c. zero out differential pressure when a new pipe is presented for running into the wellbore when a zero differential pressure button is actuated.

14. The drilling rig of claim 1, wherein the weight on bit monitoring and controlling section, the rate of penetration monitoring and controlling section, the differential pressure monitoring and controlling section, or combinations thereof are used simultaneously to control drilling.

* * * * *